US008044647B2

(12) United States Patent
Kang

(10) Patent No.: US 8,044,647 B2
(45) Date of Patent: Oct. 25, 2011

(54) VOLTAGE DOWN CONVERTER

(75) Inventor: Dong-Keum Kang, Ichon (KR)

(73) Assignee: Hynix Semiconductor Inc. (KR)

( * ) Notice: Subject to any disclaimer, the term of this patent is extended or adjusted under 35 U.S.C. 154(b) by 900 days.

(21) Appl. No.: 11/962,039

(22) Filed: Dec. 20, 2007

(65) Prior Publication Data

US 2008/0278126 A1 Nov. 13, 2008

(30) Foreign Application Priority Data

May 10, 2007 (KR) ..... 10-2007-0045409

(51) Int. Cl.
*G05F 1/40* (2006.01)
*G05F 3/16* (2006.01)

(52) U.S. Cl. ..... 323/280; 323/274; 323/314

(58) Field of Classification Search ..... 323/312–317, 323/274, 280, 281; 327/540–544
See application file for complete search history.

(56) References Cited

U.S. PATENT DOCUMENTS

| | | | | |
|---|---|---|---|---|
| 5,452,896 | A | 9/1995 | Core | |
| 5,532,618 | A | 7/1996 | Hardee et al. | |
| 6,184,744 | B1 * | 2/2001 | Morishita | 327/541 |
| 6,407,538 | B1 * | 6/2002 | Kinoshita et al. | 323/314 |
| 7,208,931 | B2 | 4/2007 | Aota | |
| 7,298,200 | B2 * | 11/2007 | Won | 327/541 |
| 7,307,469 | B2 * | 12/2007 | Yamada et al. | 327/540 |
| 2005/0231269 | A1 | 10/2005 | Kim et al. | |
| 2006/0091938 | A1 | 5/2006 | Kim | |

FOREIGN PATENT DOCUMENTS

| | | |
|---|---|---|
| KR | 10-1997-0012684 | 3/1997 |
| KR | 10-0247785 | 12/1999 |
| KR | 10-2006-0110045 | 10/2006 |
| KR | 10-2007-0000166 | 1/2007 |

* cited by examiner

*Primary Examiner* — Jessica Han
(74) *Attorney, Agent, or Firm* — Baker & McKenzie LLP

(57) ABSTRACT

A voltage down converter includes a voltage comparator for comparing a first reference voltage and an internal voltage to provide a first driving signal; a driving signal controller coupled with the voltage comparator, the driving signal controller configured to generate a second driving signal in response to an external voltage and selectively providing any one of the first and second driving signals; and a voltage supply coupled with the driving signal controller, the voltage supply configured to receive the selectively provided first and second driving signals, wherein the voltage supply is activated in accordance with the first or second driving signal, thereby providing the internal voltage.

14 Claims, 4 Drawing Sheets

VOLTAGE DOWN CONVERTER

CROSS-REFERENCES TO RELATED APPLICATION

The present application claims priority under 35 U.S.C. 119(a) to Korean Patent Application number 10-2007-0045409, filed on May 10, 2007, in the Korean Intellectual Property Office, the contents of which are incorporated herein by reference in their entirety as if set forth in full.

BACKGROUND

1. Technical Field

The embodiments described herein relate to a voltage down converter and, more particularly, to a voltage down converter for dropping an external voltage to provide an internal voltage.

2. Related Art

Generally, a voltage down converter is used in a semiconductor integrated circuit to drop an external voltage, thereby providing an internal voltage that is more stable with respect to changes in the external voltage. Accordingly, the reliability of circuit operations can be improved due to the more stable internal voltage, and operational power can be reduced, thereby reducing power consumption.

In order to set such an internal voltage to a predetermined voltage, a reference voltage is compared with an internal voltage, and a voltage supply is driven with the compared signal. However, as external voltages are becoming lower and lower, the compared signal may not be sufficient to drive the voltage supply due to the size of the voltage supply, which may make it difficult to provide a stable internal voltage.

SUMMARY

According to one aspect, there is provided a voltage down converter including a voltage comparator for comparing a first reference voltage and an internal voltage to provide a first driving signal, a driving signal controller coupled with the voltage comparator, the driving signal controller configured to generate a second driving signal in response to an external voltage and selectively providing any one of the first and second driving signals and a voltage supply coupled with the driving signal controller, the voltage supply configured to receive the selectively provided first and second driving signals, wherein the voltage supply is activated in accordance with the first or second driving signal, thereby providing the internal voltage.

The driving signal controller can include a switching signal generator configured to sense the external voltage and generate a switching signal, a first switching unit the switching signal generator and configured to be turned on in response to a first voltage level of the switching signal, a second switching unit coupled with the switching signal generator and configured to be turned on in response to a second voltage level of the switching signal, and a current source that is coupled with the second switching unit to provide the second driving signal to the second switching unit.

The first switching unit can be coupled with the voltage comparator, thereby receiving the first driving signal provided from the voltage comparator. The second switching unit can be coupled with the current source, thereby receiving the second driving signal provided from the current source.

Meanwhile, the first and second voltage levels of the switching signal can be inverted relative to each other.

The switching signal generator can include a voltage sensing circuit configured to receive and sense the external voltage. If the sensed external voltage is equal to or greater than a predetermined level, then the switching signal generator can provide a switching signal at the first voltage level. If the sensed external voltage is less than the predetermined level, then the switching signal generator can provide the switching signal at the second voltage level.

The first and second switching units can include switching elements for selectively providing the first and second driving signals in response to the voltage level of the switching signal, respectively.

The current source in the driving signal controller can sink current when the current source is activated. The voltage comparator can include a current mirror-type differential amplifier. The internal voltage provided from the voltage supply can be fed back to the voltage comparator. If the internal voltage is higher than the first reference voltage, then the voltage supply can be deactivated to block supply of the external voltage. If the internal voltage is lower than the first reference voltage and the external voltage is less than the second reference voltage, then the voltage supply can be activated by the second driving signal. If the internal voltage is lower than the first reference voltage and the external voltage is equal to or greater than the second reference voltage, then the voltage supply can be activated by the first driving signal According to another aspect, a voltage down converter includes a voltage comparator configured to compare a first reference voltage and an internal voltage to provide a first driving signal, a driving signal controller configured to sense an external voltage to provide an output path of a signal that has a small swing range if the external voltage is equal to or greater than a second reference voltage, and to provide an output path of a ground voltage level signal if the external voltage is less then the second reference voltage, and a voltage supply controlled in accordance with the signal that has a small swing range or the signal that is at a ground voltage level. The voltage down converter further comprises a switching signal generator for sensing the external voltage and generating a switching signal, a first switching unit turned on in response to a first voltage level of the switching signal, a second switching unit turned on in response to a second voltage level of the switching signal, and a current source coupled with the second switching unit to provide a second driving signal to the second switching driving signal to the second switching unit.

The first and second voltage levels of the switching signal can be inverted relative to each other. The switching signal generator provides the switching signal that is in the first voltage level when the sensed external voltage is the second reference voltage or more.

The switching signal generator can provide the switching signal that is in the second voltage level when the sensed external voltage is less than the second reference voltage.

The current source in the driving signal controller sinks current when the current source is activated. Meanwhile, the voltage comparator includes a current mirror-type differential amplifier.

These and other features, aspects, and embodiments are described below in the section entitled "Detailed Description."

BRIEF DESCRIPTION OF THE DRAWINGS

The above and other aspects, features and other advantages of the subject matter of the present disclosure will be more clearly understood from the following detailed description taken in conjunction with the accompanying drawings, in which.

DETAILED DESCRIPTION

According to the embodiments described herein, a current driving ability for an internal voltage generated in a semiconductor integrated circuit can be enhanced when an external voltage is less than a predetermined level. In such instances, a voltage supply can be controlled with a driving signal that responds to a sensed external voltage. The driving signal can be determined and driven using a simple method of sensing an external voltage, so that a power voltage can be more stably provided. Such a voltage down converter will be described in detail below.

Figure 1:
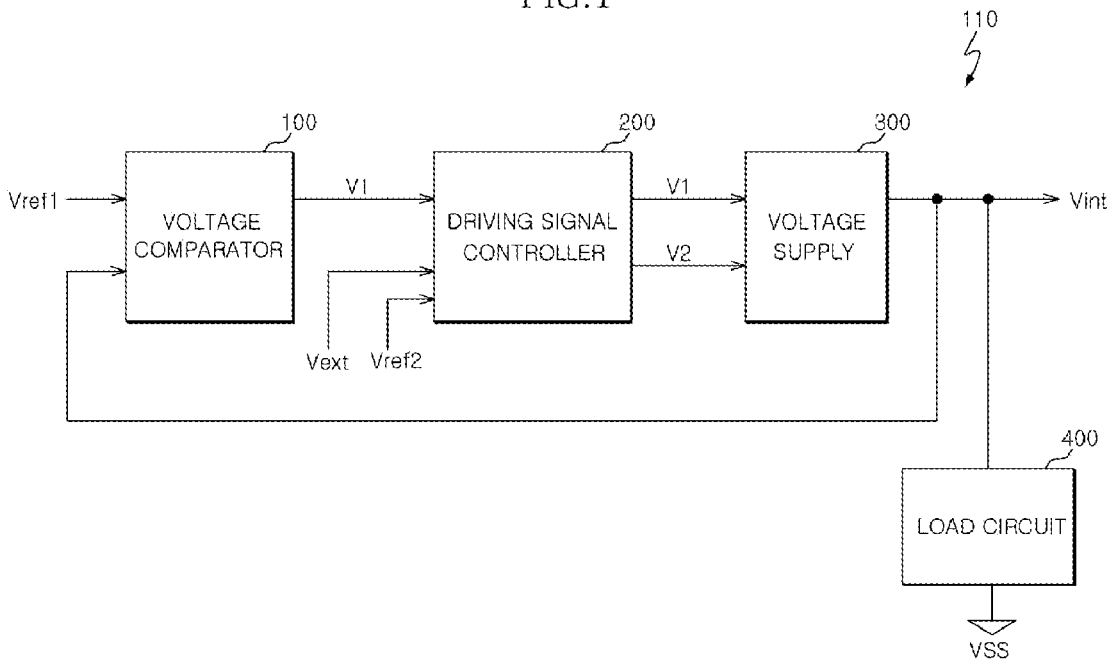
FIG. 1 is a block diagram of a voltage down converter according to one embodiment.

FIG. 1 is a diagram illustrating an example voltage down converter 110 according to one embodiment. As can be seen, voltage down converter 110 can include a voltage comparator 100, a driving signal controller 200, a voltage supply 300 and a load circuit 400. The voltage comparator 100 can be configured to compare a first reference voltage Vref1 and an internal voltage Vint to provide a first driving signal (V1).

More specifically, the voltage comparator 100 can be configured to compare a weak differential signal between the first reference voltage Vref1 and the internal voltage Vint to provide the first driving signal (V1). Here, the first driving signal (V1) is a high- or low-level signal that has a small swing range. That is, the first driving signal (V1) provided from the voltage comparator 100 can have a voltage level that is at a high or low analog level.

Depending on the embodiment, the voltage comparator 100 can include a general current mirror-type comparator as described in detail below with respect to FIG. 6.

The driving signal controller 200 can be configured to selectively provide either the first or the second driving signals (V1) and (V2), respectively, depending on a sensed external voltage Vext. Here, the second driving voltage signal (V2) is a signal provided in response to the sensed external voltage Vext.

In other words, the driving signal controller 200 can be configured to selectively provide the first and second driving signals (V1) and (V2) in accordance with the comparison result of the applied external voltage Vext and a second reference voltage Vref2, which has a predetermined level. When the external voltage Vext is less than the second reference signal Vref2, then the driving signal controller 200 provides the second driving signal (V2) to enhance a current driving ability. However, when the external voltage Vext is equal to or greater than the second reference voltage Vref2, then the driving signal controller 200 controls the path of a signal to provide the first driving signal (V1). Here, the second reference voltage Vref2 is lower than the first reference voltage (V1).

That is, when the external voltage Vext is less than the second reference voltage Vref2, i.e., is at a low voltage level, the first driving signal (V1) from the voltage comparator 100 is not sufficient to drive the voltage supply 300. Therefore, the driving signal controller 200 blocks the first driving signal (V1) and provides the second driving signal (V2) to compensate an internal voltage Vint. It should be noted that when Vext is less than the second reference voltage Vref2, then the internal voltage Vint is lower than the first reference voltage Vref1. When the external voltage Vext is less than the second reference voltage Vref2, then the second driving signal (V2) will activate the voltage supply 300 to compensate for the internal voltage Vint. However, if the external voltage is a predetermined level or more, then the driving signal controller 200 can be configured to provide the first driving signal (V1) to voltage supply 300 and block the second driving signal (V2).

The driving signal controller 200 can include an external voltage sensing circuit for sensing the external voltage Vext. The external voltage sensing circuit will be described in detail below.

The voltage supply 300 can be activated based on the first and second driving signals (V1) and (V2) provided by the driving signal controller 200. That is, if the voltage supply 300 receives the second driving signal (V2), then it can be activated to compensate for the internal voltage Vint. Meanwhile, if the voltage supply 300 receives the first driving signal (V1), then it can be activated to compensate for the internal voltage Vint or it can instead block the compensation for the internal voltage Vint, depending on the voltage level of the first driving signal (V1). Here, the voltage supply 300 can be a big driver in terms of the area occupied.

The load circuit 400 can be an internal circuit that is coupled with the voltage supply 300 and uses the internal voltage Vint. That is, the load circuit 400 uses the internal voltage Vint provided from the voltage supply 300 and thereby generates a load current flowing through the load circuit 400. Therefore, a larger voltage drop occurs relative to the internal voltage Vint than the external voltage Vext when generating a constant voltage. Here, the load circuit 400 may be a peripheral circuit, a sense-amplifying circuit, or the like.

As described above, the voltage down converter 110 can include the driving signal controller 200, thereby providing the second driving signal (V2) with which a driving ability can be enhanced at a low voltage that is less than a predetermined level. Accordingly, the operation of the voltage down converter can reliably and stably be implemented even at a low voltage.

Figure 2:
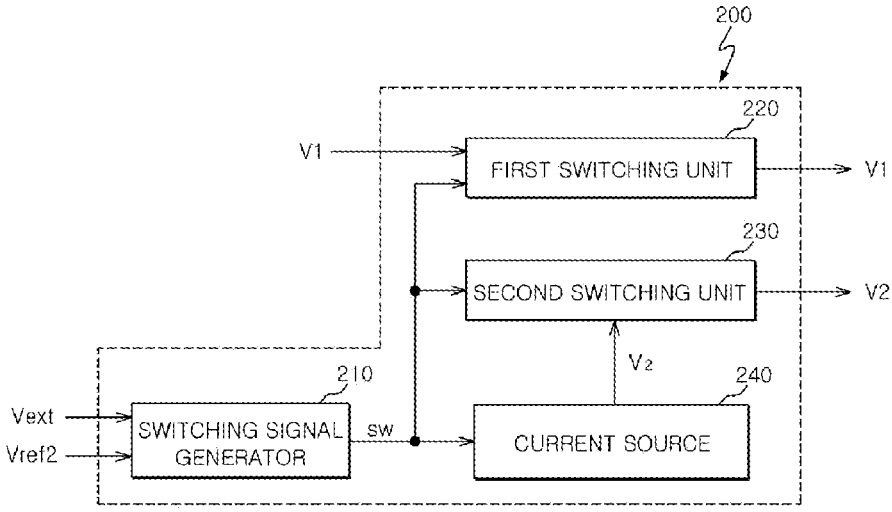
FIG. 2 is a block diagram of a driving signal controller included in the voltage down converter illustrated in FIG. 1.

FIG. 2 is a diagram illustrating an example implementation of a driving signal controller 200. As can be seen, the driving signal controller 200 can include a switching signal generator 210, a first switching unit 220, a second switching unit 230 and a current source 240.

First, the operation of the switching signal generator 210 will be described. If the sensed external voltage Vext is higher than the second reference voltage Vref2, then the switching signal generator 210 provides a low-level switching signal (sw). If the sensed external voltage Vext is lower than the second reference voltage Vref2, then the switching signal generator 210 provides a high-level switching signal (sw).

The first switching unit 220 is coupled with the voltage comparator (reference numeral 100 in FIG. 1) to receive the first driving signal (V1). Hence, the first switching unit 220 is turned on in response to the low-level switching signal (sw), thereby transmitting the first driving signal (V1).

The second switching unit 230 is coupled with the current source 240 to receive the second driving signal (V2) provided when the current source 240 is activated. Hence, the second switch 230 is turned on in response to the high-level switching signal (sw), thereby transmitting the second driving signal (V2).

The current source 240 is coupled with the second switch 230 and is activated in response to the high-level switching signal (sw), thereby providing the second driving signal (V2). More specifically, if the current source 240 is activated then it will sink a current and generate the second driving signal (V2). At this time, the second driving signal (V2) provided from the current source 240 is a signal that is at a ground voltage level. That is, if the switching signal (sw) is in a high level, the second switching unit 230 is turned on and thus the second voltage signal (V2), which will be at a ground voltage level is transmitted to the voltage supply (reference numeral 300 in FIG. 1).

Figure 3:
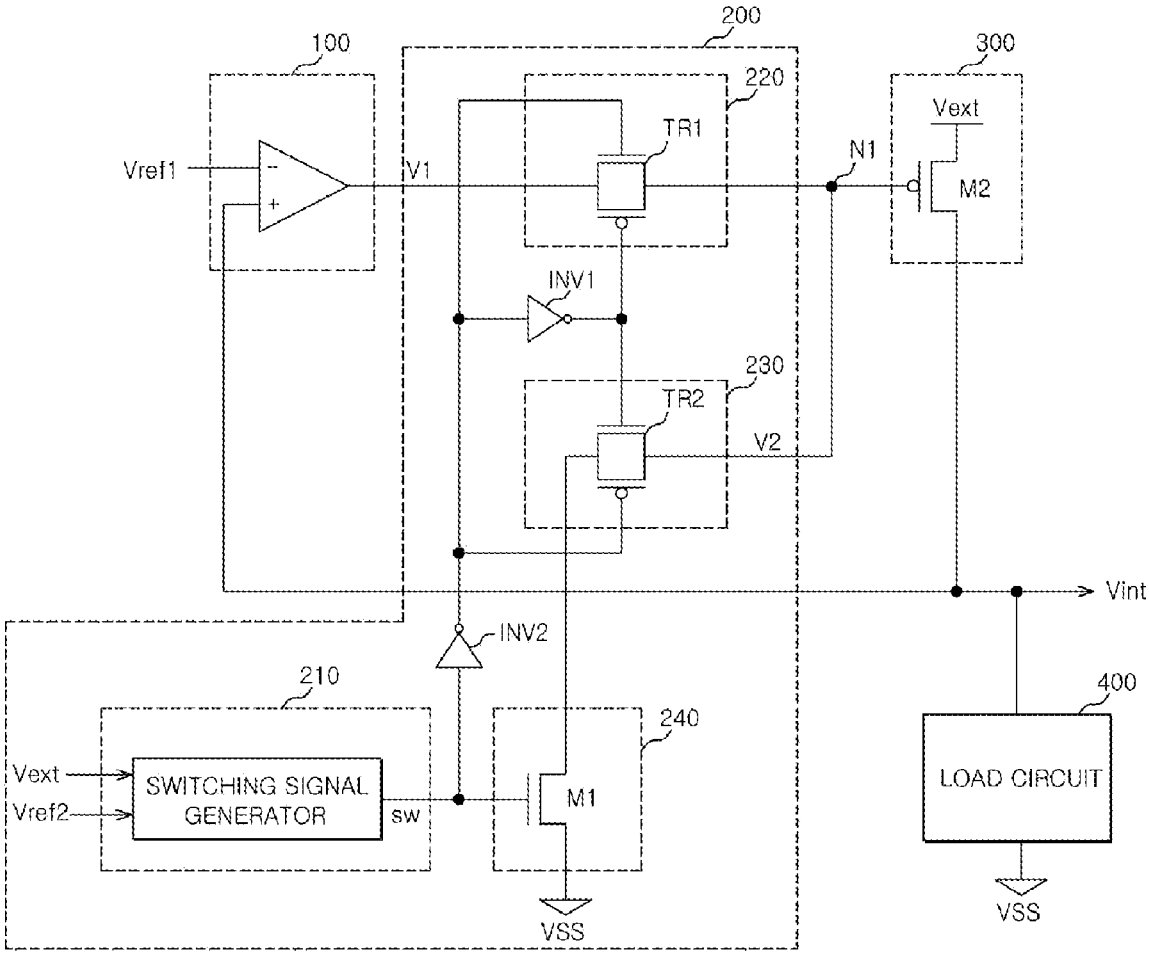
FIG. 3 is a circuit diagram of the voltage down converter illustrated in FIG. 1.

Referring to FIG. 3, the voltage comparator 100 can be configured to compare the first reference voltage Vref1 with the internal voltage Vint and provide the first driving signal (V1). If the internal voltage Vint is lower than the first reference voltage Vref1, then the voltage comparator 100 provides the low-level first driving signal (V1). On the other hand, if the internal voltage Vint is higher than the first reference voltage Vref1, then the voltage comparator 100 provides the high-level first driving signal (V1). As described above, the voltage comparator 100 can include the current mirror-type comparator. The voltage level of the first driving signal (V1), which is an output signal of the voltage comparator 100, is a signal level with a small swing range. Moreover, if the external voltage Vext is at a low voltage, then the voltage comparator 100 can be configured to provide the first driving signal (V1) at a weaker level to drive the voltage supply 300. The configuration of the voltage comparator 100 will be described in detail later.

Still referring to FIG. 3 and as described above, the driving signal controller 200 can include the switching signal generator 210, the first and second switching units 220 and 230 and the current source 240.

The switching signal generator 210 can be configured to receive the external voltage Vext and the second reference voltage Vref2 and provide the switching signal (sw) based thereon. Here, the second reference voltage Vref2 can be a voltage of a predetermined-level for determining when the external voltage Vext is at a low level.

Although the second reference voltage Vref2 is illustrated as a voltage that has a level lower than the first reference voltage Vref1, the embodiments described here are not necessarily so limited.

As described above, the switching signal generator 210 can provide a low- or high-level switching signal (sw) in accordance with the logic level of the sensed external voltage Vext relative to the second reference voltage Vref2. The switching signal generator 210 can include a voltage sensor. The detailed configuration and operation of the switching signal generator 210 will be described later.

The first switching unit 220 can be positioned between the voltage comparator 100 and the voltage supply 300. The first switching unit 220 can be configured to receive the first driving signal (V1) and is controlled by the switching signal (sw). The first switching unit 220 includes a first pass transistor TR1. Hence, if the low-level switching signal (sw) turns on the first switching unit 220 via first and second inverters INV1 and INV2, then the first driving signal (V1) can be transmitted to the voltage supply 300.

The second switching unit 230 can be positioned between the current source 240 and the voltage supply 300. The second switching unit 230 can be configured to receive the second driving signal (V2), and is controlled by the switching signal (sw). The second switching unit 230 includes a second pass transistor TR2. Hence, if the high-level switching signal (sw) turns on the second switching unit 230 via the first and second inverters INV1 and INV2, then the second driving signal (V2) can be transmitted to the voltage supply 300.

The current source 240 can include an NMOS transistor M1. The NMOS transistor M1 can include a gate for receiving the switching signal (sw), a drain coupled with the second switching unit 230, and a source coupled with ground power VSS. Hence, if the current source 240 receives the high-level switching signal (sw), it will turned on and sink a current, thereby providing the second driving signal (V2) that is at a ground voltage level.

The voltage supply 300 can include a PMOS transistor M2. The PMOS transistor M2 can include a gate coupled with a node N1 that is an output terminal of the first and second switching units 220 and 230, a drain coupled with the internal voltage Vint and the load circuit 400, and a source coupled with the external voltage Vext. Accordingly, the voltage supply 300 can provide the external voltage Vext as the internal voltage Vint or block the external voltage Vext, depending on the voltage level of the first and second driving signals (V1) and (V2).

The operation of voltage down converter 110 will now be describe with reference to FIG. 3. First, it will be assumed that the external voltage Vext is lower than the second reference voltage Vref2, and the internal voltage Vint is lower than the first reference voltage Vref1. If the external voltage Vext is lower than the second reference voltage Vref2, then the first driving signal (V1) of the voltage comparator 100 is weak. Therefore, it may be insufficient to provide the first driving signal (V1) as the internal voltage Vint with which the voltage supply 300 is driven.

If the external voltage Vext is lower than the second reference voltage Vref2, then the switching signal generator 210 provides the high-level switching signal (sw). It will be apparent that the switching signal (sw) is not a signal that is at a CMOS level. However, the switching signal (sw) can be a signal that can turn on the small-sized NMOS transistor M1 and the first and second transistors TR1 and TR2. Hence, the first switching unit 220 is turned off, and the second switching unit 230 is turned on. In addition, the current source 240 that receives the high-level switching signal (sw) is operated, thereby providing the second driving signal (V2) activated in a low level to the node N1 via the second switching unit 230.

Therefore, the voltage supply 300 is turned on by the low-level second driving signal (V2) received to the node N1 to increase and compensate for the internal voltage Vint while supplying the external voltage Vext. At this time, the internal voltage Vint may be provided to an internal circuit at a lower level than the external voltage Vext due to the drop in voltage caused by the load current of the load circuit 400.

According to one embodiment, when the PMOS transistor M2 is turned on by the second driving signal (V2), which is in a ground voltage level, the VGS (the voltage gap between the gate and the source) of the PMOS transistor M2 is large. Therefore, the voltage supply 300 can be sufficiently driven with the second driving signal (V2).

If the external voltage is higher than the second reference voltage Vref2, the switching signal generator 210 provides the low-level switching signal (sw). The first switching unit 220 is turned on, and the second switching unit 230 is turned off. Similarly, the current source 240 that receives the low-level switching signal (sw) is also turned off. In this case, the voltage supply 300 is operated depending on the voltage level of the first driving signal (V1) provided as the comparison result of the first reference voltage Vref1 and the internal voltage Vint.

If the internal voltage Vint is lower than the first reference voltage Vref1, then the voltage comparator 100 provides the low-level first driving signal (V1). The first switching unit 220 is turned on, thereby providing the low-level first driving signal (V1) to the node N1. The voltage supply 300 that receives the low-level first driving signal (V1) is activated, thereby providing the external voltage Vext and compensating for the internal voltage Vint. Here, it can be considered that the driving ability of the first driving signal (V1) that is a comparison signal of the voltage comparator 100 is more enhanced than that of the aforementioned low external voltage Vext.

Meanwhile, if the internal voltage Vint is higher than the first reference voltage Vref1, the voltage comparator 100 provides a high-level first driving signal (V1). The first driving signal (V1) is provided to the node N1 via the first switching unit 220. The voltage supply 300 that receives the high-level first driving signal (V1) is turned off, or deactivated, thereby blocking the path through which the external voltage Vext compensates for the internal voltage Vint. As described above, if the external voltage Vext is more than a predetermined voltage level and the internal voltage is also higher than the first reference voltage Vref1, it is necessary to prevent the internal voltage Vint from being unnecessarily increased.

Figure 4:
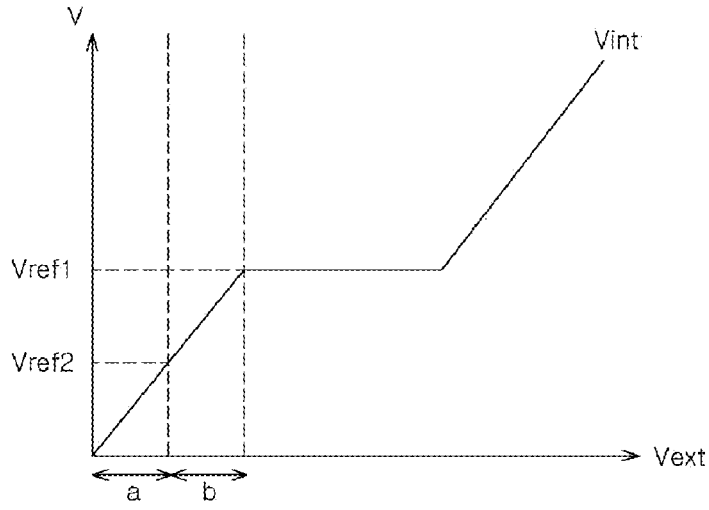
FIG. 4 is a graph illustrating a voltage characteristic of an internal voltage with respect to an external voltage.

FIG. 4 is a graph illustrating various voltage ranges for the external voltage Vext with respect to an internal voltage Vin. The section designated "a" illustrates a case where the external voltage Vext is lower than the second reference voltage Vref2 and the internal voltage Vint is also lower than the first reference voltage Vref2. At this time, the voltage supply 300 is driven with the second driving signal (V2), i.e., a ground voltage level, to compensate for the internal voltage Vint sufficiently.

The section designated "b" illustrates a case where the external voltage Vext is higher than the second reference voltage Vref2 but the internal voltage Vint is still lower than the first reference voltage Vref1. In this case, the first driving signal provided from the voltage comparator 100 has a recovered driving ability. Since the internal voltage Vint is also lower than the first reference voltage Vref1, the voltage supply 300 is driven with the first driving signal (V1) so as to sufficiently compensate for the internal voltage Vint.

The section after the section designated as "b" illustrates a case where the internal voltage Vint is higher than the first reference voltage Vref1. In this case, the voltage supply 300 is not driven with the first driving signal (V1) such that the external voltage Vext is not supplied to the internal voltage Vint any more.

Figure 5:
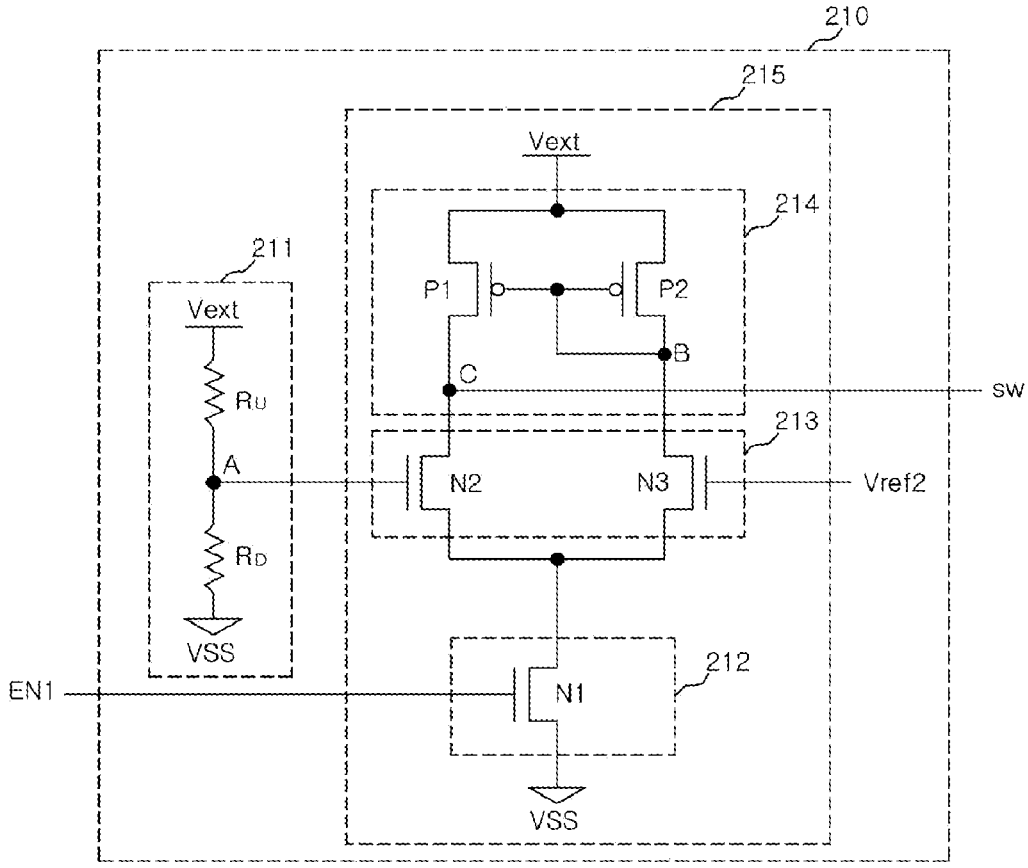
FIG. 5 is a circuit diagram of a switching signal generator included in the voltage down converter illustrated in FIG. 1.

FIG. 5 is a circuit diagram illustrating an example implementation of switching signal generator 210. Here, switching signal generator 210 is illustrated as an external voltage sensing circuit; however it will be understood that the embodiments described herein are not necessarily so limited.

Referring to FIG. 5, the voltage dividing unit 211 can include resistors $R_U$ and $R_D$ in series connected between external power VDD and ground power VSS. Hence, the external power VDD is divided by the resistors $R_U$ and $R_D$ to output the divided external power VDD through a common node A of the resistors $R_U$ and $R_D$. Here, the resistors $R_U$ and $R_D$ are illustrated as two resistors for convenience of illustration. It will be apparent that two pairs of resistors are respectively provided at both sides of the node A, depending on the configuration of a circuit. Also, not only passive elements but also active elements can replace the resistors.

The differential amplifier 215 can also include an input controller 212, a differential input unit 213 and an amplifier 214.

The input controller 212 can be configured to receive a first control signal (EN1) at a gate of a first NMOS transistor N1 to activate the switching signal generator 210 when the first control signal (EN1) is at a high level. Here, the first control signal (EN1) can be a signal activated by a chip activation signal. However, the embodiments described herein are not limited thereto.

The differential input unit 213 can be configured to receive a voltage signal at the node A and the second reference voltage Vref2. The differential input unit 213 can include second and third NMOS transistors N2 and N3 positioned opposite to each other. Gates of the second and third NMOS transistors N2 and N3 can receive the voltage signal at the node A, respectively. The respective sources of the second and third NMOS transistors N2 and N3 are commonly coupled with the input controller 212.

The amplifier 214 can be positioned between the differential input unit 213 and the external voltage Vext. The amplifier 214 mirrors the current provided from the differential input unit 213 to provide a high- or low-level signal. The amplifier 214 can include first and second PMOS transistor P1 and P2 with gates coupled with node B. The power voltage Vext is coupled with sources of the first and second PMOS transistors P1 and P2. Drains of the first and second PMOS transistors P1 and P2 are coupled with nodes C and B, respectively.

The operation of the switching signal generator 210 will now be described. If the first control signal is activated, then the switching signal generator 210 compares a voltage level at the node A and the second reference voltage Vref2. If the voltage level at the node A is higher than the second reference voltage Vref2, the second NMOS transistor N2 is slightly turned on, and thus the node C can be in a low level. That is, if the sensed external voltage Vext is higher than the second reference voltage Vref2, the switching signal generator 210 can provide a low-level switching signal (sw). If the voltage level at the node A is lower than the second reference voltage Vref2, the third NMOS transistor N3 is turned on, and thus the node C is in a high level to provide the high-level switching signal (sw). Accordingly, the switching signal generator 210 compares the sensed external voltage Vext and the second reference voltage Vref2, thereby providing the switching signal (sw). It will be apparent that the switching signal (sw) may not be a signal that is in a CMOS level. However, the switching signal (sw) is sufficient to turn on elements that have a small size.

Figure 6:
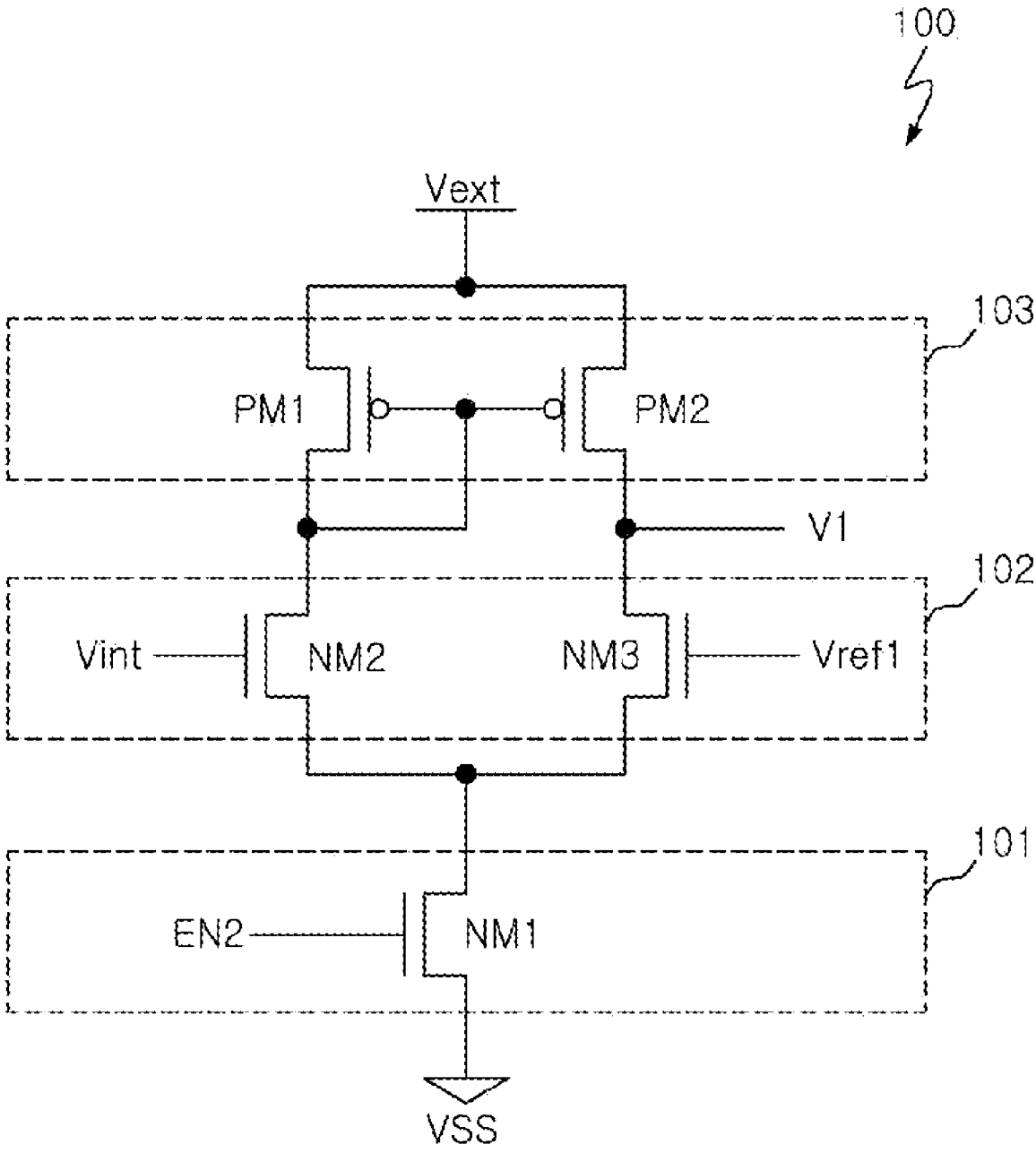
FIG. 6 is a circuit diagram of a voltage comparator included in the voltage down converter illustrated in FIG. 1.

FIG. 6 is a circuit diagram illustrating an example implementation of a current mirror comparator that can be used for voltage comparator 100 It will be understood that although a general current mirror-type comparator is shown here, the embodiments described herein are not necessarily limited thereto.

Referring to FIG. 6, an input of the voltage comparator 100 can be controlled by a second control signal (EN2). The voltage comparator 100 can be configured to compare a voltage difference between the first reference voltage Vref1 and the internal voltage Vint to provide the first driving signal (V1). Here, the second control signal (EN2) can be a signal activated by a chip activation signal. However, it will be understood that the second control signal (EN2) can be generated in a different manner, e.g., based on a different signal.

The voltage comparator 100 senses a current in accordance with the voltage difference between the internal voltage Vint and the first reference voltage Vref1, and performs mirroring of the voltage difference, thereby providing the first driving signal (V1). Since the configuration and operation of the voltage comparator 100 overlap with the aforementioned description, they will be briefly described.

First, the voltage comparator 100 includes an input controller 101, an input comparator 102 and an amplifier 103.

The input controller 101 includes a first NMOS transistor NM1 for receiving the second control signal (EN2). The input controller 101 controls the operation of the voltage comparator 100.

The input comparator 102 compares the first reference voltage Vref1 and the internal voltage Vint. The input comparator 102 includes second and third NMOS transistors NM2 and NM3.

The amplifier 103 is positioned between the input comparator 102 and the external voltage Vext. The amplifier 103 includes first and second PMOS transistors PM1 and PM2 for mirroring a difference of currents driven by the input comparator 102.

The voltage comparator 100 compares the first reference voltage Vref1 and the internal voltage Vint to provide the first driving signal (V1). However, the first driving signal (V1).

As described above, the voltage down converter 110 can include a current source for providing a ground voltage level driving signal so as to improve the driving ability of the driving signal in the voltage comparator when the low-voltage external voltage is applied to the voltage comparator. In addition, the voltage down converter can include a switching signal generator for appropriately selecting the driving signal depending on the sensed external voltage, so that the driving ability of the voltage supply can be enhanced.

While certain embodiments have been described above, it will be understood that the embodiments described are by way of example only. Accordingly, the apparatus and methods described herein should not be limited based on the described embodiments. Rather, the apparatus and methods described herein should only be limited in light of the claims that follow when taken in conjunction with the above description and accompanying drawings.

What is claimed is:

1. A voltage down converter, comprising:

a voltage comparator for comparing a first reference voltage and an internal voltage to provide a first driving signal;

a driving signal controller coupled with the voltage comparator, the driving signal controller configured to generate a second driving signal in response to an external voltage and selectively provide any one of the first and second driving signals; and a voltage supply coupled with the driving signal controller, the voltage supply configured to receive the selectively provided first and second driving signals, wherein the voltage supply is activated in accordance with the first or second driving signal, thereby providing the internal voltage.

2. The voltage down converter of claim 1, wherein the driving signal controller comprises:

a switching signal generator configured to sense the external voltage and generate a switching signal;

a first switching unit coupled with the switching signal generator and configured to be turned on in response to a first voltage level of the switching signal;

a second switching unit coupled with the switching signal generator and configured to be turned on in response to a second voltage level of the switching signal; and a current source coupled with the second switching unit and configured to provide the second driving signal to the second switching unit.

3. The voltage down converter of claim 2, wherein the first switching unit is coupled with the voltage comparator, thereby receiving the first driving signal provided from the voltage comparator.

4. The voltage down converter of claim 2, wherein the second switching unit is coupled with the current source, thereby receiving the second driving signal provided from the current source.

5. The voltage down converter of claim 2, wherein the first and second voltage levels of the switching signal are inverted to each other.

6. The voltage down converter of claim 2, wherein the switching signal generator comprises a voltage sensing circuit configured to receive and sense the external voltage.

7. The voltage down converter of claim 6, wherein the switching signal generator is configured to provide the switching signal of the first voltage level when the sensed external voltage is equal to or greater than a predetermined level.

8. The voltage down converter of claim 6, wherein the switching signal generator is configured to provide the switching signal that is in the second voltage level when the sensed external voltage is less than a predetermined level.

9. The voltage down converter of claim 2, wherein the first and second switching units comprise switching elements configured to selectively provide the first and second driving signals in response to the voltage level of the switching signal, respectively.

10. The voltage down converter of claim 2, wherein the current source in the driving signal controller is configured to sink current when the current source is activated.

11. The voltage down converter of claim 1, wherein the internal voltage provided from the voltage supply is fed back to the voltage comparator.

12. The voltage down converter of claim 1, wherein the voltage supply is deactivated to block supply of the external voltage when the internal voltage is higher than the first reference voltage.

13. The voltage down converter of claim 1, wherein the voltage supply is activated by the second driving signal when the internal voltage is lower than the first reference voltage and the external voltage is less than the second reference voltage.

14. The voltage down converter of claim 1, wherein the voltage supply is activated by the first driving signal when the internal voltage is lower than the first reference voltage and the external voltage is the second reference voltage or more.

* * * * *